US011828018B2

(12) United States Patent
Rios Acebal et al.

(10) Patent No.: US 11,828,018 B2
(45) **Date of Patent: *Nov. 28, 2023**

(54) LAUNDRY TREATING APPLIANCE HAVING A CONDENSER

(71) Applicant: WHIRLPOOL CORPORATION, Benton Harbor, MI (US)

(72) Inventors: Marcos Javier Rios Acebal, Monterrey (MX); Jenn-Yeu Nieh, Saint Joseph, MI (US); Brian Keith Rogers, Watervliet, MI (US); Nicholas B. Vaive, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/872,515

(22) Filed: Jul. 25, 2022

(65) Prior Publication Data

US 2022/0372693 A1 Nov. 24, 2022

Related U.S. Application Data

(62) Division of application No. 16/723,641, filed on Dec. 20, 2019, now Pat. No. 11,434,601.

(51) Int. Cl.

| | |
|---|---|
| ***D06F 58/24*** | (2006.01) |
| ***D06F 58/20*** | (2006.01) |
| ***D06F 58/36*** | (2020.01) |
| ***D06F 39/08*** | (2006.01) |
| ***D06F 29/00*** | (2006.01) |

(52) U.S. Cl.
CPC ..... *D06F 58/24* (2013.01); *D06F 29/005* (2013.01); *D06F 39/088* (2013.01); *D06F 58/206* (2013.01); *D06F 58/36* (2020.02)

(58) Field of Classification Search
CPC ..... D06F 58/24
See application file for complete search history.

(56) References Cited

U.S. PATENT DOCUMENTS

| | | | |
|---|---|---|---|
| 3,805,404 | A | 4/1974 | Gould |
| 2009/0071033 | A1 | 3/2009 | Ahn et al. |
| 2014/0109428 | A1 | 4/2014 | Kim et al. |

FOREIGN PATENT DOCUMENTS

| | | | |
|---|---|---|---|
| CN | 1814895 | A | 8/2006 |
| CN | 201746712 | U | 2/2011 |
| CN | 102071563 | A | 5/2011 |
| CN | 203247438 | U | 10/2013 |
| CN | 106968079 | A | 7/2017 |
| CN | 109281118 | A | 1/2019 |
| EP | 2366828 | B1 | 11/2017 |
| KR | 20060004363 | A | 1/2006 |
| KR | 20100053945 | A | 5/2010 |

OTHER PUBLICATIONS

Chinese Office Action for Counterpart CN202011513751.5, dated Jan. 20, 2023, 7 Pages.

*Primary Examiner* — Jason Y Ko
(74) *Attorney, Agent, or Firm* — McGarry Bair PC

(57) ABSTRACT

A liquid-cooled condenser for use within a laundry treating appliance for treating laundry according to an automatic cycle of operation includes an air flow passage. The air flow passage is fluidly coupled with an air recirculation circuit. A plurality of fins is spaced from the air flow passage. The liquid-cooled condenser also includes a liquid flow passage.

14 Claims, 5 Drawing Sheets

LAUNDRY TREATING APPLIANCE HAVING A CONDENSER

CROSS-REFERENCE TO RELATED APPLICATION(S)

The present application is a divisional of U.S. patent application Ser. No. 16/723,641, filed on Dec. 20, 2019, now U.S. Pat. No. 11,434,601, issued Sep. 6, 2022, which is incorporated herein by reference in its entirety.

BACKGROUND

Laundry treating appliances, such as washing machines, combination washer/dryers, refreshers, and non-aqueous systems, can have a configuration based on a rotating laundry basket or drum that defines a drum opening and at least partially defines a treating chamber in which laundry items are placed for treating. The laundry treating appliance can have a controller that implements a number of user-selectable, pre-programmed cycles of operation having one or more operating parameters. Hot air, cold air, or a mixture thereof can be supplied to the treating chamber in accordance with the cycle of operation and via an air recirculation circuit.

In laundry treating appliances with air recirculation circuits, typically a heater and a blower are provided in the air recirculation circuit to supply heated drying air through the treating chamber to evaporate moisture from a load of laundry. In an open loop circuit, the blower can then move moisture-laden process air exiting the treating chamber to an exterior of the laundry treating appliance, such as outside of the building within which the laundry treating appliance is located. In a closed loop circuit, the moisture-laden process air can pass through a condenser to remove the moisture from the process air, the process air can be heated again by the heater, and the heated drying air can be supplied back into the treating chamber for continued drying.

BRIEF SUMMARY

In one aspect, the present disclosure relates to a liquid-cooled condenser for use within a laundry treating appliance for treating laundry according to an automatic cycle of operation, the liquid-cooled condenser comprising an air flow passage fluidly coupled with an air recirculation circuit, a plurality of fins spaced from the air flow passage, and a liquid flow passage provided in the space between the air flow passage and the plurality of fins.

In another aspect, the present disclosure relates to a laundry treating appliance for treating laundry according to an automatic cycle of operation, the laundry treating appliance comprising a cabinet defining a cabinet interior, a container, rotatable within the cabinet interior, and at least partially defining a treating chamber, the treating chamber having a treating chamber air inlet and a treating chamber air outlet, an air recirculation circuit fluidly coupling the treating chamber air outlet to the treating chamber air inlet, and a liquid-cooled condenser comprising a plurality of fins spaced from the air recirculation circuit, and a liquid flow passage provided adjacent the air recirculation circuit and the plurality of fins.

DETAILED DESCRIPTION

Figure 1:
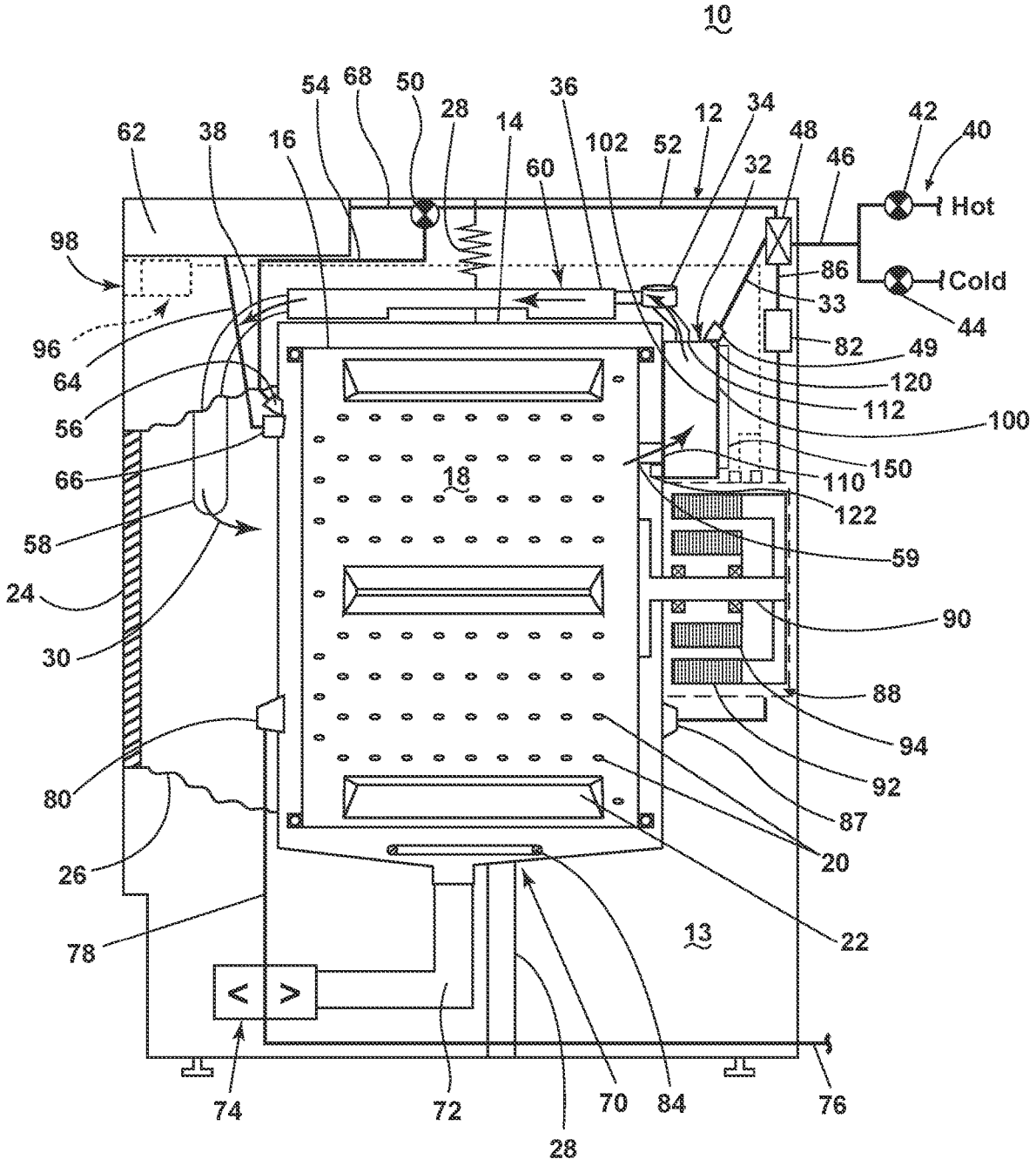
FIG. 1 illustrates a schematic cross-sectional view of a laundry treating appliance including an air recirculation circuit and a liquid-cooled condenser comprising a plurality of fins.

FIG. 1 is a schematic cross-sectional view of a laundry treating appliance 10 according to an aspect of the present disclosure. The laundry treating appliance 10 can be any laundry treating appliance 10 which performs a cycle of operation, which can be an automatic cycle of operation, to clean or otherwise treat laundry items placed therein, non-limiting examples of which include a horizontal or vertical axis clothes washer; a horizontal or vertical axis clothes dryer; a combination washing machine and dryer; a tumbling or stationary refreshing/revitalizing machine; an extractor; a non-aqueous washing apparatus; and a revitalizing machine. While the laundry treating appliance 10 is illustrated herein as a horizontal axis, front-load laundry treating appliance 10, the aspects of the present disclosure can have applicability in laundry treating appliances with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 is illustrated as a horizontal axis combination washing and drying laundry treating appliance 10, though it will be understood that the laundry treating appliance 10 need not be a combination washing and drying laundry treating appliance 10, but that any suitable laundry treating appliance 10 for drying laundry items can be provided, including a clothes dryer. The laundry treating appliance 10 can include a structural support assembly comprising a cabinet 12 which defines a housing within which a laundry holding assembly resides. The cabinet 12 can be a housing having a chassis and/or a frame, to which decorative panels can or cannot be mounted, defining a cabinet interior 13 and enclosing components typically found in a conventional laundry treating appliance, such as motors, pumps, fluid lines, controls, sensors, transducers, and the like. Such components will not be described further herein except as necessary for a complete understanding of the present disclosure.

The laundry holding assembly of the illustrated laundry treating appliance 10 can include a tub 14 dynamically suspended within the structural support assembly of the cabinet 12 by a suitable suspension assembly 28, the tub 14 at least partially defining a treating chamber 18 for laundry items. A container, illustrated herein as a rotatable drum 16 can be provided within the tub 14 to further define at least a portion of the laundry treating chamber 18. The treating chamber 18 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket.

The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It is also within the scope of the present disclosure for the laundry holding assembly to comprise only one receptacle, such as the tub 14 without the drum 16, or the drum 16 without the tub 14, with the single receptacle defining the laundry treating chamber 18 for receiving the load to be treated.

The laundry holding assembly can further include a closure, illustrated herein as a door assembly 24, which can be movably mounted to or coupled to the cabinet 12 to selectively close both the tub 14 and the drum 16, as well as the treating chamber 18. In one example, the door assembly 24 can be rotatable relative to the cabinet 12. By way of non-limiting example, the door assembly 24 can be hingedly coupled to the cabinet 12 for movement between an opened condition (not shown) and a closed condition as shown.

A bellows 26 can extend between the tub 14 and the cabinet 12 to couple an open face of the tub 14 with the cabinet 12, with the door assembly 24 sealing against the bellows 26 or the cabinet 12, or both, when the door assembly 24 closes the tub 14. In the opened condition, the door assembly 24 can be spaced apart from the bellows 26 and can allow access to the treating chamber 18. The bellows 26 can sealingly couple the open face of the tub 14 with the cabinet 12 such that liquid is not permitted to move from the tub 14 into the interior 13 of the cabinet 12.

The laundry treating appliance 10 can optionally further comprise a washing circuit which can include a liquid supply assembly for supplying liquid, such as water or a combination of water and one or more wash aids, such as detergent, to the laundry treating appliance 10 for use in treating laundry during a cycle of operation. The liquid supply assembly can include a source of water, such as a household water supply 40, which can include separate valves 42 and 44 for controlling the flow of hot and cold water, respectively. The valves 42, 44 can be opened individually or together to provide a mix of hot and cold water at a selected temperature. The valves 42, 44 are selectively openable to provide water, such as from the household water supply 40, to be supplied through an inlet conduit 46 directly to the tub 14 or the drum 16 by controlling first and second diverter mechanisms 48 and 50, respectively. The diverter mechanisms 48, 50 can each be a diverter valve having at least two outlets such that each of the diverter mechanisms 48, 50 can selectively direct a flow of liquid to one or more of the at least two outlets or flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14 in a desired pattern and under a desired amount of pressure. For example, the spray nozzle 56 can be configured to dispense a flow or stream of water into the tub 14 by gravity, i.e. a non-pressurized stream. In this manner, water from the household water supply 40 can be supplied directly to the tub 14. While the valves 42, 44 and the conduit 46 are illustrated exteriorly of the cabinet 12, it will be understood that these components can be internal to the cabinet interior 13.

The laundry treating appliance 10 can also optionally be provided with a dispensing assembly for dispensing treating chemistry to the treating chamber 18 for use in treating the laundry according to a cycle of operation. The dispensing assembly can include a treating chemistry dispenser 62 which can be a single dose dispenser, a bulk dispenser, or an integrated single dose and bulk dispenser and is fluidly coupled to the treating chamber 18. The treating chemistry dispenser 62 can be configured to dispense a treating chemistry directly to the tub 14 or mixed with water from the liquid supply assembly through a dispensing outlet conduit 64. The treating chemistry dispenser 62 can include means for supplying or mixing detergent to or with water from the water supply 40. Alternatively, or additionally, water from the water supply 40 can also be supplied to the tub 14 through the treating chemistry dispenser 62 without the addition of a detergent. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 62 from the supply conduit 52 by directing the diverter mechanism 50 to direct the flow of water to a dispensing supply conduit 68.

The treating chemistry dispenser 62 can include multiple chambers or reservoirs for receiving doses of different treating chemistries. The treating chemistry dispenser 62 can be implemented as a dispensing drawer that is slidably received within the cabinet 12, or within a separate dispenser housing which can be provided in the cabinet 12. The treating chemistry dispenser 62 can be moveable between a fill position, where the treating chemistry dispenser 62 is exterior to the cabinet 12 and can be filled with treating chemistry, and a dispense position, where the treating chemistry dispenser 62 are provided in the cabinet interior 13.

Non-limiting examples of treating chemistries that can be dispensed by the dispensing assembly during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

The laundry treating appliance 10 can also include a recirculation and drain assembly for recirculating liquid within the laundry holding assembly and draining liquid from the laundry treating appliance 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14 and fluidly coupled with the treating chamber 18. The sump 70 can also be formed by a sump conduit 72 that can fluidly couple the lower portion of the tub 14 to a pump 74. The pump 74 can have an inlet fluidly coupled with the sump 70 and an outlet configured to fluidly couple and to direct liquid to a drain conduit 76, which can drain the liquid from the laundry treating appliance 10, or to a recirculation conduit 78, which can terminate at a recirculation inlet 80. In this configuration, the pump 74 can be used to drain or recirculate wash water in the sump 70. The recirculation inlet 80 can direct the liquid from the recirculation conduit 78 into the drum 16 by fluidly coupling the recirculation conduit 78 with the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry, can be recirculated into the treating chamber 18 for treating the laundry within. The recirculation and drain assembly can include other types of recirculation systems.

The liquid supply and/or recirculation and drain assembly can be provided with a heating assembly which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation. The sump heater 84 can be provided within the sump 70 to heat liquid that collects in the sump 70. Alternatively, the heating assembly can include an in-line heater that heats the liquid as it flows through the liquid supply, dispensing, and/or recirculation assemblies.

It is noted that the illustrated suspension assembly, liquid supply assembly, recirculation and drain assembly, and dispensing assembly are shown for exemplary purposes only and are not limited to the assemblies shown in the drawings and described above. For example, the liquid supply, dispensing, and recirculation and pump assemblies can differ from the configuration shown in FIG. 1, such as by inclusion of other valves, conduits, treating chemistry dispensers, heaters, sensors (such as water level sensors and temperature sensors), and the like, to control the flow of liquid through the laundry treating appliance 10 and for the introduction of more than one type of treating chemistry. For example, the liquid supply assembly can include a single valve for controlling the flow of water from the household water source. In another example, the recirculation and pump assembly can include two separate pumps for recirculation and draining, instead of the single pump as previously described. In yet another example, the liquid supply assembly can be configured to supply liquid into the interior of the drum 16 or into the interior of the tub 14 not occupied by the drum 16, such that liquid can be supplied directly to the tub 14 without having to travel through the drum 16.

The laundry treating appliance 10 also includes a drive assembly for rotating the drum 16 within the tub 14. The drive assembly can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used.

The motor 88 can rotationally drive the drum 16, including that the motor 88 can rotate the drum 16 at various speeds in either rotational direction. In particular, the motor 88 can rotate the drum 16 at tumbling speeds wherein the laundry items in the drum 16 rotate with the drum 16 from a lowest location of the drum 16 towards a highest location of the drum 16, but fall back to the lowest location of the drum 16 before reaching the highest location of the drum 16. The rotation of the laundry items with the drum 16 can be facilitated by the baffles 22. Typically, the force applied to the laundry items at the tumbling speeds is less than about 1 G. Alternatively, the motor 88 can rotate the drum 16 at spin speeds wherein the laundry items rotate with the drum 16 without falling. The spin speeds can also be referred to as satellizing speeds or sticking speeds. Typically, the force applied to the laundry items at the spin speeds is greater than or about equal to 1 G. As used herein, "tumbling" of the drum 16 refers to rotating the drum 16 at a tumble speed, "spinning" the drum 16 refers to rotating the drum 16 at a spin speed, and "rotating" of the drum 16 refers to rotating the drum 16 at any speed.

The laundry treating appliance 10 can further comprise an air recirculation circuit 60 fluidly coupled to the treating chamber 18 for circulating air to laundry items, such as for drying laundry items. In one example, the air recirculation circuit 60 can be provided as a drying air recirculation circuit 60. The air recirculation circuit 60 can be a closed loop circuit or an open loop circuit. The air recirculation circuit 60 can comprise a treating chamber air inlet 58 and a treating chamber air outlet 59, and specifically can fluidly couple the treating chamber air outlet 59 to the treating chamber air inlet 58 and can be configured to supply air, such as drying air, through the treating chamber 18 from the treating chamber air inlet 58 to the treating chamber air outlet 59. While the treating chamber air inlet 58 is illustrated herein as being provided on the bellows 26, it will be understood that the treating chamber air inlet 58 can be any provided at any suitable position of the treating chamber 18, including as an opening in at least one of the drum 16 or the tub 14. The treating chamber air outlet 59 is illustrated herein as being provided at a rear wall of the tub 14, the drum 16, and the treating chamber 18, though such a position is not limiting. The treating chamber air inlet 58 and the treating chamber air outlet 59 can be provided at any suitable locations of the treating chamber 18 so long as they are spaced from one another to allow air to flow through the treating chamber 18.

In one example, the air recirculation circuit 60 can be provided as a closed loop, or recirculating, air recirculation circuit 60, as illustrated herein. The closed loop air recirculation circuit 60 can define an air flow pathway, which can be a drying air flow pathway, as indicated by the arrows 30, to recirculate air through the treating chamber 18. The closed loop air recirculation circuit 60 can include a condenser 32, a blower 34, a heating portion 36, and an air conduit 38. The condenser 32 can be provided with a condenser drain conduit (not shown) that fluidly couples the condenser 32 with the pump 74 and the drain conduit 76. Additionally, or alternatively, the condenser 32 can be fluidly coupled with the pump 74 and the drain conduit 76 by way of the condenser 32 fluidly coupling with the sump 70. Liquid collected within the condenser 32, such as condensed liquid, can flow through the condenser drain conduit or through the sump 70, to the pump 74, where it can be provided to the recirculation and drain assembly. The blower 34 is fluidly coupled to the treating chamber 18 such that actuation of the blower 34 supplies or circulates air through the treating chamber 18 by flowing air from the treating chamber air inlet 58 to the treating chamber air outlet 59. The heating portion 36 can enclose at least one heater or heating element (not shown) that is configured to heat recirculating air that flows through the air recirculation circuit 60. In one example, the air recirculation circuit 60 can be provided adjacent an upper portion of the tub 14, though it will be understood that the air recirculation circuit 60 need not be provided adjacent the upper portion of the tub 14, and can be provided at any suitable location adjacent the tub 14 or the treating chamber 18.

The condenser 32 can be provided as a liquid-cooled condenser 32 including a condenser housing 100 that at least partially defines the liquid-cooled condenser 32 and components that can be included with the liquid-cooled condenser 32. The liquid-cooled condenser 32 further comprises a set of fins 150 provided along at least a portion of the liquid-cooled condenser 32, such as along at least a portion of the condenser housing 100. In one example, the set of fins 150 can extend along at least a portion of a rear wall 102 of the condenser housing 100.

The condenser housing 100 can include or at least partially define a condenser air inlet 110 and a condenser air outlet 112 in fluid communication with the air recirculation circuit 60 and with the treating chamber 18. The condenser air inlet 110 and the condenser air outlet 112 can be spaced from one another to define an air flow through the liquid-cooled condenser 32, such as through the condenser housing 100. By way of non-limiting example, the condenser air inlet 110 can be positioned adjacent to and fluidly coupled with the treating chamber air outlet 59 and the condenser air outlet 112 can be positioned adjacent to and fluidly coupled with another component of the air recirculation circuit 60, such as the blower 34.

The condenser housing 100 further includes or defines a liquid inlet 120 and a liquid outlet 122 spaced from one another to define a liquid flow through the liquid-cooled condenser 32, such as through the condenser housing 100. By way of non-limiting example, the liquid inlet 120 and the liquid outlet 122 can be in fluid communication with the recirculation and drain assembly via the sump 70, and specifically such that the liquid outlet 122 fluidly couples the liquid-cooled condenser 32 with the sump 70.

The liquid inlet 120 and the liquid outlet 122 can further be in fluid communication with the liquid supply assembly. For example, the liquid supply assembly can further comprise a condenser conduit 33 configured to direct a flow of liquid and to supply liquid to the liquid-cooled condenser 32. The condenser conduit 33 is in fluid communication with the liquid inlet 120 to supply liquid to the liquid-cooled condenser 32. The condenser conduit 33 can be provided with a condenser spray nozzle 49 configured to spray the flow of liquid into the liquid-cooled condenser 32 in a desired pattern and under a desired amount of pressure. For example, the condenser spray nozzle 49 can be configured to dispense a flow or stream of liquid, such as water, into the liquid-cooled condenser 32 by gravity, i.e. a non-pressurized stream.

In one example, condenser conduit 33 can be selectively fluidly coupled with the first diverter mechanism 48 such that the first diverter mechanism 48 can selectively direct the flow of liquid to the condenser conduit 33 to fluidly couple the liquid-cooled condenser 32 with the liquid supply assembly. By way of further example, the first diverter mechanism 48 can be configured to supply water specifically from the cold water of the household water supply 40 via the valve 44. However, the condenser conduit 33 is not limited to being fluidly coupled with the liquid supply assembly by the first diverter mechanism 48 and can instead be fluidly coupled to the liquid supply assembly at any other suitable location, non-limiting examples of which include that the condenser conduit 33 can include a separate valve (not shown) dedicated to the condenser conduit 33 and fluidly coupling the condenser conduit 33 with the liquid supply assembly at another conduit, such as the supply conduit 52, the tub outlet conduit 54, or the steam supply conduit 86, that the condenser conduit 33 can be selectively fluidly coupled with the inlet conduit 46 upstream of the first diverter mechanism 48, or that the condenser conduit 33 can be selectively fluidly coupled directly with the household water supply 40, such as specifically to the cold water supply, at the valve 44.

In one example, the air flow pathway 30 can pass through the components of the closed loop air recirculation circuit 60, such that air exiting the treating chamber 18 through the treating chamber air outlet 59 flows through the liquid-cooled condenser 32, through the blower 34, through the heating portion 36 to be heated to optionally become drying air, and then through the air conduit 38 to enter the treating chamber 18 through the treating chamber air inlet 58. More specifically, air exiting the treating chamber 18 through the treating chamber air outlet 59 can flow through the condenser air inlet 110, into and through the liquid-cooled condenser 32, and then through the condenser air outlet 112 to the blower 34. However, while the blower 34 is illustrated herein as being provided in between the condenser 32 and the heating portion 36, and specifically downstream of the condenser 32 and upstream of the heating portion 36, it will be understood that the blower 34 can be provided at any suitable location within the air recirculation circuit 60 so as to drive the supply of air along the air flow pathway 30. By way of non-limiting example, the blower 34 can be provided between the treating chamber air outlet 59 and the condenser 32 or between the heating portion 36 and the treating chamber air inlet 58. Further, while the closed loop air recirculation circuit 60 is illustrated herein as including both the condenser 32 and the heating portion 36, it will be understood that the closed loop air recirculation circuit 60 could also include the condenser 32, but not the heating portion 36, or could include the heating portion 36, but not the condenser 32.

If the air recirculation circuit 60 is provided as an open loop air recirculation circuit 60, the condenser 32 may not be necessary. Alternatively, or additionally, the blower 34, instead of, or in addition to, being fluidly coupled with the condenser 32, can be fluidly coupled with an ambient air source, which can draw ambient air either from within the cabinet interior 13 or from the exterior of the cabinet 12. The ambient air can be provided from the blower 34 to the heating portion 36 to be heated to be provided through the air conduit 38 to enter the treating chamber 18 through the treating chamber air inlet 58. Air that flows through the treating chamber 18 gathers moisture from the laundry items within the treating chamber 18, and is then exhausted through the treating chamber air outlet 59 and can be exhausted to the exterior of the cabinet 12. As the drying air is not being recirculated to the treating chamber 18, no condensing is necessary. In such an example, while the blower 34 is illustrated as being provided upstream of the heating portion 36, it will also be understood that the blower 34 can be provided between the heating portion 36 and the treating chamber air inlet 58. Additionally, or alternatively, the same blower 34 or an additional blower 34 can be provided downstream of the treating chamber air outlet 59 to draw the exhaust air out of the treating chamber 18. Further, in such an example, the condenser 32 can be included such that the blower 34 can be selectively fluidly coupled with the condenser 32 to optionally draw air from the ambient air source or from the condenser 32, as well as to optionally provide the drawn air either to the condenser 32 or to be exhausted to the exterior of the cabinet 12.

The laundry treating appliance 10 also includes a control assembly for controlling the operation of the laundry treating appliance 10 and its various working components to control the operation of the working components and to implement one or more treating cycles of operation. The control assembly can include a controller 96 located within the cabinet 12 and a user interface 98 that is operably coupled with the controller 96. The user interface 98 can provide an input and output function for the controller 96. In one example, the user interface 98 can be provided or integrated with the door assembly 24. In another example, as shown, the user interface 98 can be provided on a front panel of the cabinet 12.

The user interface 98 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 96 to communicate with the user in a variety of ways. For example, the controller 96 can be configured to send a text message to the user, send an electronic mail to the user, or provide audio information to the user either through the laundry treating appliance 10 or utilizing another device such as a mobile phone.

The controller 96 can include the machine controller and any additional controllers provided for controlling any of the components of the laundry treating appliance 10. For example, the controller 96 can include the machine controller and a motor controller. Many known types of controllers can be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
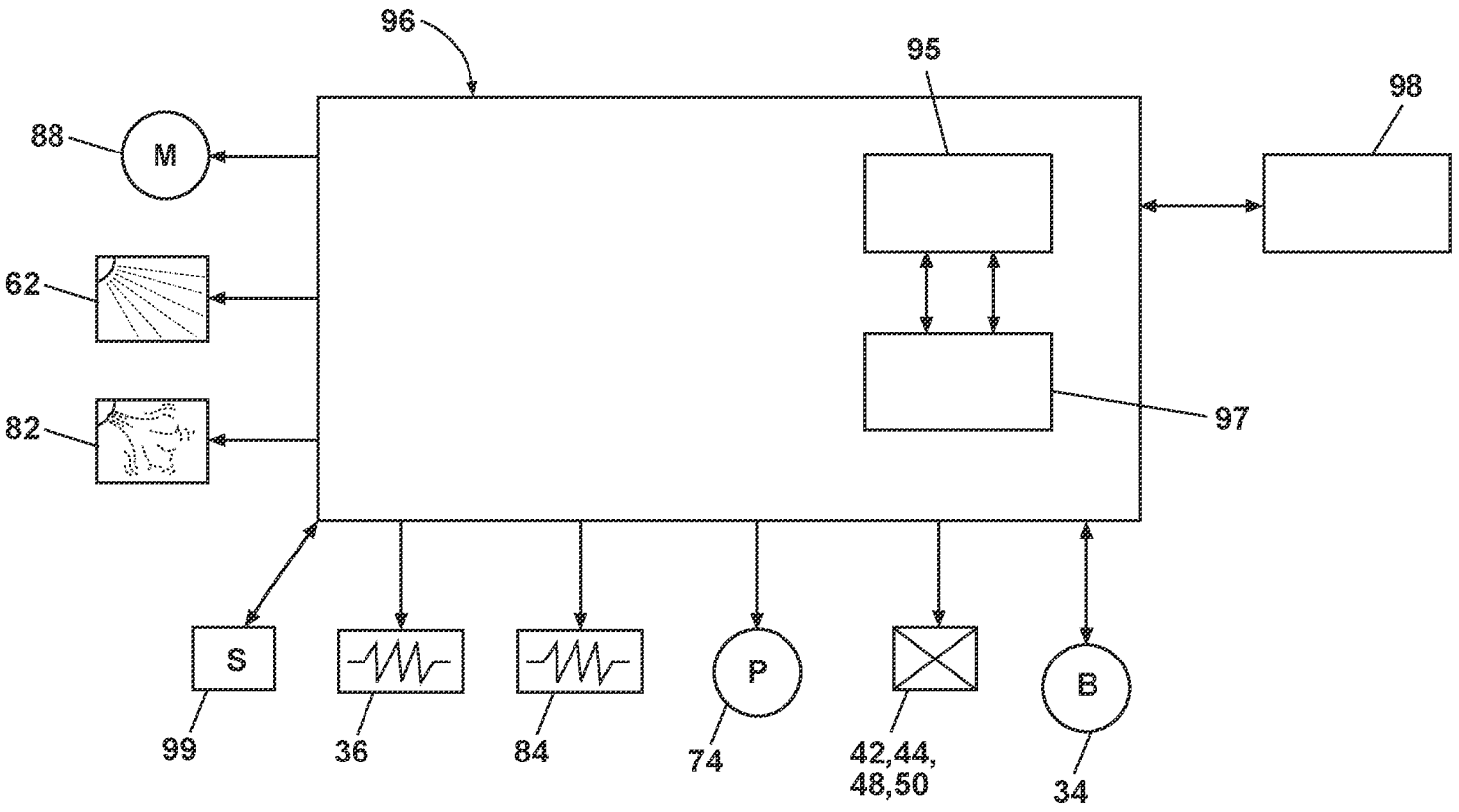
FIG. 2 illustrates a schematic of a control assembly of the laundry treating appliance of FIG. 1.

As illustrated in FIG. 2, the controller 96 can be provided with a memory 95 and a central processing unit (CPU) 97. The memory 95 can be used for storing the control software that is executed by the CPU 97 in completing a cycle of operation using the laundry treating appliance 10 and any additional software. For example, the memory 95 can store a set of executable instructions including at least one user-selectable cycle of operation. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 98. The memory 95 can also be used to store information, such as a database or table, and to store data received from one or more components of the laundry treating appliance 10 that can be communicably coupled with the controller 96. The database or table can be used to store the various operating parameters for the one or more cycles of operation, including factory default values for the operating parameters and any adjustments to them by the control assembly or by user input.

The controller 96 can be operably coupled with one or more components of the laundry treating appliance 10 for communicating with and controlling the operation of the component to complete a cycle of operation. For example, the controller 96 can be operably coupled with the valves 42, 44 and the diverter mechanisms 48, 50 for controlling the temperature and flow rate of treating liquid into the treating chamber 18, the motor 88 for controlling the direction and speed of rotation of the drum 16, the pump 74 for controlling the amount of treating liquid in the treating chamber 18 or sump 70, the treating chemistry dispenser 62 for controlling the flow of treating chemistries into the treating chamber 18, the user interface 98 for receiving user selected inputs and communicating information to the user, the steam generator 82, the sump heater 84, and the air recirculation circuit 60, including the blower 34 and the heating portion 36, for circulating air or drying air through the treating chamber 18, to control the operation of these and other components to implement one or more of the cycles of operation.

The controller 96 can also be coupled with one or more sensors 99 provided in one or more of the assemblies of the laundry treating appliance 10 to receive input from the sensors 99, which are known in the art and not shown for simplicity. Non-limiting examples of sensors 99 that can be communicably coupled with the controller 96 include: a treating chamber temperature sensor, such as a thermistor, which can detect the temperature of the treating liquid in the treating chamber 18 and/or the temperature of the treating liquid being supplied to the treating chamber 18, a moisture sensor, a weight sensor, a chemical sensor, a position sensor, an imbalance sensor, a load size sensor, and a motor torque sensor, which can be used to determine a variety of assembly and laundry characteristics, such as laundry load inertia or mass.

Figure 3:
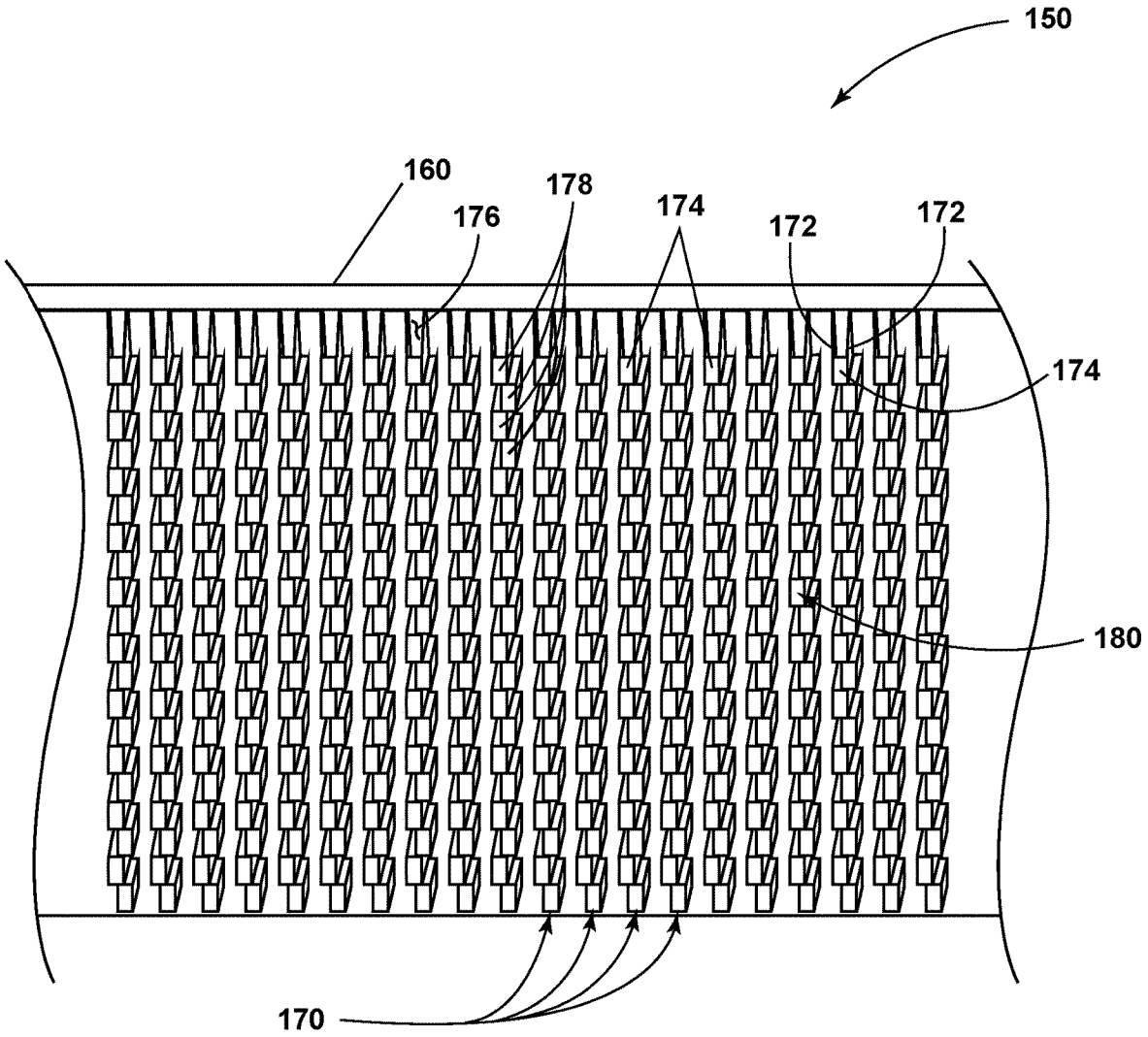
FIG. 3 illustrates a top perspective view of an example of a set of fins that can be used with the liquid-cooled condenser of FIG. 1.

Referring now to FIG. 3, an example of the set of fins 150 that can be provided with the liquid-cooled condenser 32 is shown. The set of fins 150 can include any suitable number, such as that the set of fins 150 comprises a plurality of individual fins 170, as illustrated herein. The set of fins 150 comprises a support surface, illustrated herein as a plate 160, to which the fins 170 can be coupled such that the fins 170 extend outwardly from at least a single surface or a single side of the plate 160. The fins 170 can be coupled to the plate 160 by any suitable method of attachment, non-limiting examples of which include that the fins 170 can be applied to, mounted to, or formed with the plate 160. The fins 170 and the plate 160 can be formed of any suitable material and, in one example, can be formed of a material or materials that are thermally conductive. In a further example, the fins 170 and the plate 160 can be formed of the same thermally conductive material, though it will be understood that the plate 160 and the fins 170 could be formed of different materials.

The plate 160 can be thought of as defining the shape or profile of the set of fins 150 by defining the surface from which the fins 170 extend. The shape and size of the plate 160 can be selected based upon the shape and size of the condenser housing 100 such that the set of fins 150 will cover a desired portion of the liquid-cooled condenser 32. For example, in the case that the condenser housing 100 includes at least one flat surface, the set of fins 150, and thus also the plate 160, can be flat, while the set of fins 150, and thus also the plate 160, can instead be curved or contoured in the case that the set of fins 150 is to be applied to a curved or contoured portion of the condenser housing 100, such that the set of fins 150 and the plate 160 have a shape and profile that is complementary with at least a portion of the condenser housing 100. In one example, the set of fins 150 can be provided within the extent of a single surface of the condenser housing 100, such as, for example, that the set of fins 150 is provided to extend from only the rear wall 102. However, it will be understood that the set of fins 150 can be provided to extend along more than a single surface or wall of the condenser housing 100, such as, for example, that the set of fins 150 can extend along more than one wall of the condenser housing 100, such as the rear wall 102 and at least a side wall, or that at least a portion of the condenser housing 100 can be provided as a curved outer surface, the set of fins 150 at least partially wrapping around the condenser housing 100.

The set of fins 150, and specifically the plate 160, can be coupled to the condenser housing 100 by any suitable method of attachment, non-limiting examples of which include that the set of fins 150 can be applied to, mounted to, or attached to the condenser housing 100. Alternatively, it is contemplated that the plate 160 can comprise at least a portion of the condenser housing 100. In this way, rather than attaching the plate 160 to the condenser housing 100, the condenser housing 100 can serve as the plate 160 for the plurality of fins 170, such that the plurality of fins 170 can be coupled directly to the condenser housing 100 as they would be to the plate 160, which can also be thought of as the condenser housing 100 comprising the plate 160. In one example, the set of fins 150 can be provided on the rear wall 102 of the liquid-cooled condenser 32, which may or may not be a flat rear wall 102. The set of fins 150 can be provided to extend along at least a portion of the rear wall 102, such that the set of fins 150 extend along only a portion of the rear wall 102, or the set of fins 150 can be substantially coextensive with the rear wall 102. The condenser housing 100 can comprise the plate 160, such that the plurality of fins 170 are directly coupled to the condenser housing 100, in this example, the rear wall 102.

Each fin 170 can comprise a pair of opposing, spaced sides 172 extending away or outwardly from the plate 160 to terminate at or to form a front surface 174 of the fin 170. In one example, the spaced sides 172 at least partially define a fin interior 176, though it will be understood that it is also within the scope of the present disclosure for the fins 170 to be solid structures. The fins 170 can have any suitable shape, profile, or cross-section extending from the plate 160. By way of non-limiting example, and as illustrated herein, the fins 170 can be shaped such that the front surface 174 extends between the spaced sides 172 in a plane that is different from that of the spaced sides 172 or defining a different angle with respect to the plate 160 than the spaced sides 172. In another example, the spaced sides 172 are angled inwardly toward one another such that the spaced sides 172 extend from the plate 160 to meet with one another at an end, such that the front surface 174 can be thought of as a front edge 174 where the spaced sides 172 meet to define the front edge 174.

The plurality of fins 170 can be provided on the plate 160 in any suitable pattern, spacing, or configuration. The fins 170 can be positioned such that at least one of the spaced sides 172 of a first fin 170 abuts or at least partially confronts one of the spaced sides 172 of a second, neighboring fin 170, or at least some of the fins 170 can be spaced from one another. The plurality of fins 170 can all be uniformly spaced from one another, or at least some of the fins 170 can have spacing that is less than or more than the spacing between other fins 170. Each fin 170 has a height, defined by the distance between the plate 160 and the front surface 174, wherein all of the fins 170 can have the same height, or wherein at least some of the fins 170 differ in height. Similarly, each fin 170 has a length, defined by the distance between opposing ends of a single side 172, and a width, defined by the distance between the spaced sides 172 of a single fin 170, wherein all of the fins 170 can have the same length, the same width, or both the same length and the same width, or wherein at least some of the fins 170 differ in length, in width, or in both length and width.

Figure 4:
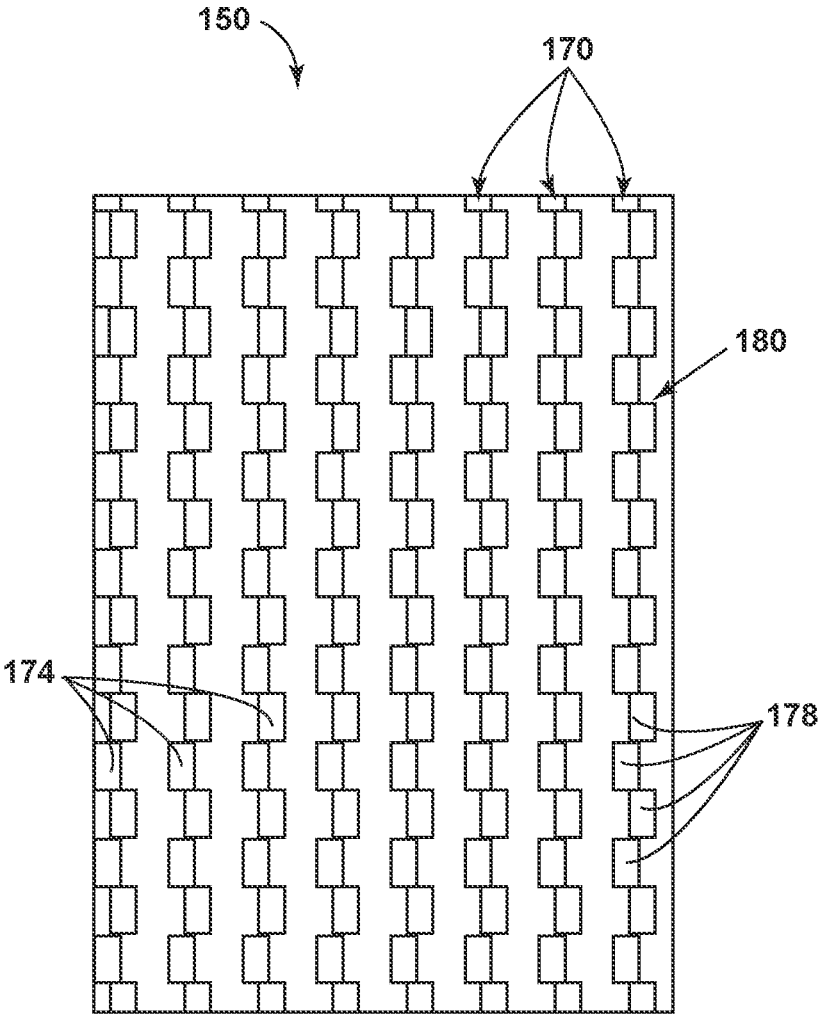
FIG. 4 illustrates a front view of a portion of the set of fins of FIG. 3.

Referring now to FIG. 4, the set of fins 150 can be thought of as collectively defining a contact surface 180 facing away or outwardly from the liquid-cooled condenser 32 and the condenser housing 100. In one example, the front surfaces 174 of each of the fins 170 can be thought of collectively as at least partially defining the contact surface 180. The contact surface 180 can face toward and at least partially confront the cabinet interior 13. The contact surface 180 can further be configured for being in thermal contact with ambient air within the cabinet interior 13. It will be understood, however, that thermal contact with the ambient air in the cabinet interior 13 is not limited to the front surfaces 174 of the contact surface 180, but that the ambient air can also thermally contact the sides 172 and/or the interiors 176 of the fins 170. The contact surface 180 is collectively defined by all of the portions of the fins 170 that are in thermal contact with the ambient air in the cabinet interior 13, such that, in this example, the sides 172, the interiors 176, and the front surfaces 174 of each of or of at least some of the fins 170 can be thought of as collectively forming the contact surface 180. The contact surface 180 can be provided to collectively define any suitable overall shape, profile, cross-section, pattern, spacing, or configuration as collectively determined by the shape, profile, cross-section, pattern, spacing, and configuration of each fin 170.

The front surfaces 174 of each fin 170 can be continuous in width and alignment along the length of each fin 170 or can vary or be discontinuous in width, in alignment, or in both width and alignment, along the length of each fin 170, such as that the front surface 174 of at least one single fin 170 has a width, an alignment, or both, that is not uniform along the length of the single fin 170. In one example, each single fin 170 can comprise a plurality of fin segments 178, each fin segment 178 having a length less than the length of the single fin 170, the fin segments 178 positioned in a side-by-side or stacked relationship such that all of the fin segments 178 of the single fin 170 collectively form, and together extend along, the length of the single fin 170. Each of the fin segments 178 of a single fin 170, in the same way as previously described with respect to each fin 170, has the height, the length, and the width wherein all of the fin segments 178 of the single fin 170 can have at least one of the same height, the same length, and the same width, or wherein at least some of the fin segments 178 of the single fin 170 can differ in at least one of the height, the length, and the width. Further, and in the same way as previously described with respect to each fin 170 and the overall contact surface 180, it will be understood that each of the fin segments 178 within the single fin 170 can have any suitable shape, profile, or cross-section, as well as any suitable pattern, spacing, or configuration relative to the other fin segments 178 of the single fin 170.

In one example, and as illustrated herein, each single fin 170 includes the plurality of the fin segments 178 with at least some of the fin segments 178 laterally offset relative to one another along the length of the single fin 170 so as to define the front surface 174 of the single fin 170 having at least an alignment that is not uniform along the length of the single fin 170. The non-uniform or discontinuous alignment of the front surface 174 along the length of the single fin 170 can have any suitable overall shape or pattern, a non-limiting example of which includes the alignment illustrated herein, which can be thought of as providing the front surface 174 with a zig-zag pattern along the length of the single fin 170. Such a zig-zag alignment can be provided regardless of whether the width of the front surface 174 of the single fin 170 is uniform or is also non-uniform, like the alignment, along the length of the single fin 170. Further, in the illustrated example, while the alignment of the front surface 174 within each fin 170 is non-uniform, the fins 170 can still have the width or alignment that is uniform relative to the other fins 170.

Further by way of example, any of the shape, profile, cross-section, pattern, spacing, configuration, height, width, length, relative positioning, or alignment of any of the fin segments 178, of any of the single fins 170, of any of the fins 170 relative to another of the fins 170, or of the overall contact surface 180 can be specifically selected to meet various parameters or functional standards, one example of which includes being specifically selected to maximize or optimize thermal contact with the ambient air in the cabinet interior 13 to improve condensing performance of the liquid-cooled condenser 32.

Figure 5:
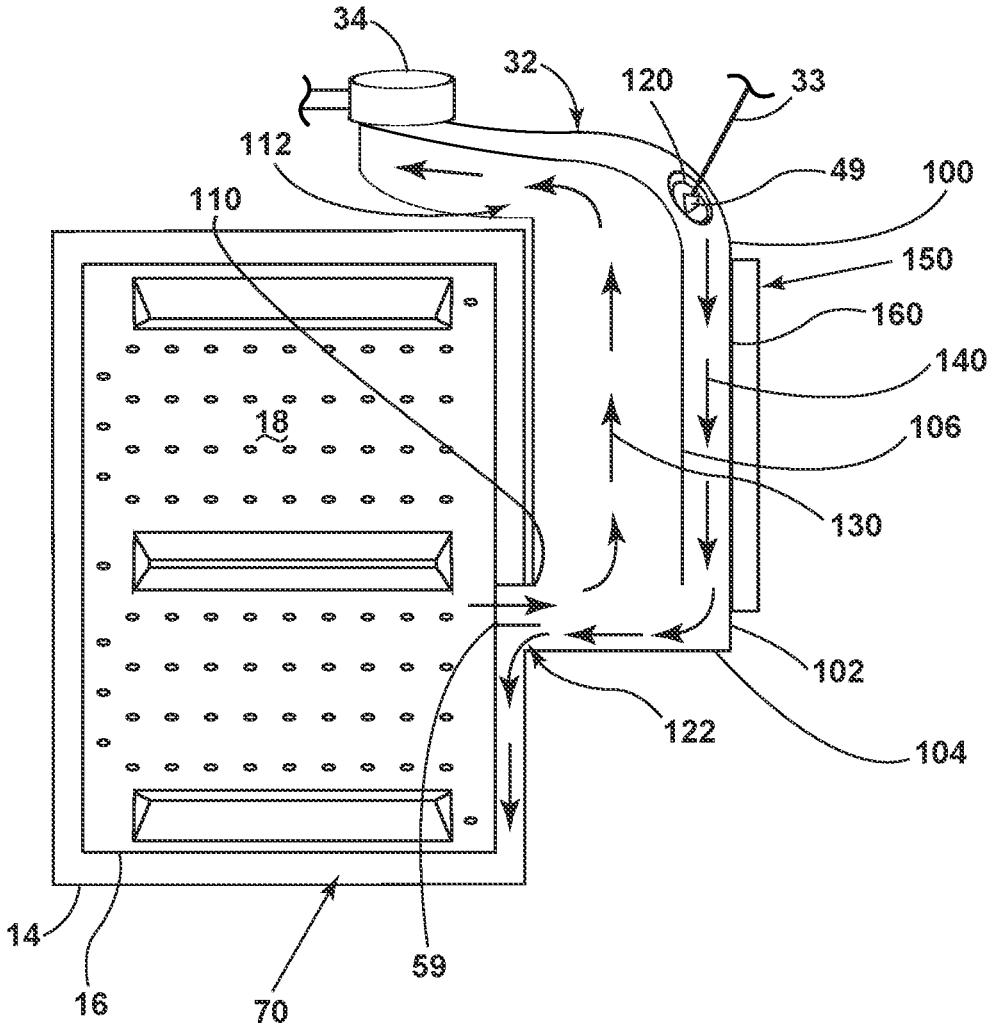
FIG. 5 illustrates a schematic cross-sectional view of the liquid-cooled condenser.

Referring now to FIG. 5, the condenser air inlet 110 is in fluid communication with the condenser air outlet 112 to at least partially define an air flow passage, illustrated herein as a condenser air flow pathway, as indicated by and in the direction of the arrows 130, the condenser air flow pathway 130 extending between the condenser air inlet 110 and the condenser air outlet 112. The liquid-cooled condenser 32, including the condenser air inlet 110 and the condenser air outlet 112, is fluidly coupled with the air recirculation circuit 60 such that at least a portion of the air recirculation circuit 60, and in turn at least a portion of the air flow pathway 30, can be thought of as comprising the liquid-cooled condenser 32. Further, the liquid-cooled condenser 32 can, in turn, also be thought of as comprising the at least a portion of the air recirculation circuit 60 and the at least a portion of the air flow pathway 30, such as that the at least a portion of the air recirculation circuit 60 and the at least a portion of the air flow pathway 30 pass through the condenser 32. More specifically, in one example, the at least a portion of the air recirculation circuit 60 and the at least a portion of the air flow pathway 30 that pass through the condenser housing 100 or are coupled with the liquid-cooled condenser 32 can be thought of as at least partially comprising, and, in turn, at least partially being comprised by, the condenser air flow pathway 130.

The liquid inlet 120 is in fluid communication with the liquid outlet 122 to at least partially define a liquid flow passage, illustrated herein as a condenser liquid flow pathway, as indicated by and in the direction of the arrows 140, the condenser liquid flow pathway 140 extending between the liquid inlet 120 and the liquid outlet 122. The condenser liquid flow pathway 140 can extend along and be at least partially defined by at least a portion of the rear wall 102. In one example, at least a portion of the condenser liquid flow pathway 140 is spaced from the tub 14 and the treating chamber 18, such as spaced by the condenser air flow pathway 130, with the condenser air flow pathway 130 provided in the space between the condenser liquid flow pathway 140 and the tub 14 or the treating chamber 18.

At least one partition 106, illustrated herein as an interior wall 106 of the condenser housing 100, can be included with the liquid-cooled condenser 32. In one example, the interior wall 106 extends generally parallel with the rear wall 102 and along a portion of the rear wall 102. The interior wall 106 is spaced from the rear wall 102, such that at least a portion of the liquid inlet 120 or at least a portion of the condenser spray nozzle 49, or both, are provided within, or overlying, the space between the rear wall 102 and the interior wall 106. The interior wall 106 can further at least partially define the condenser liquid flow pathway 140, as well as at least partially defining the condenser air flow pathway 130.

The condenser liquid flow pathway 140 is further yet at least partially defined by a bottom wall 104 of the condenser housing 100, such that the condenser liquid flow pathway 140 extends downwardly from the liquid inlet 120, between the rear wall 102 and the interior wall 106, to reach the bottom wall 104. The condenser liquid flow pathway 140 then further extends along the bottom wall 104, from the rear wall 102 to the liquid outlet 122. In one example, the liquid outlet 122 is positioned adjacent to and passing through the tub 14 such that the liquid outlet 122 is positioned and configured to provide liquid from the condenser liquid flow pathway 140 into the tub 14, and specifically to a space between the tub 14 and the drum 16, to fluidly couple the liquid outlet 122 with the sump 70. In this way, the condenser liquid flow pathway 140 can further provide liquid from the liquid outlet 122 to the sump 70. In one example, the liquid outlet 122 can be provided at a lower portion of the tub 14 to provide the liquid to the sump 70, though it will be understood that the liquid outlet 122 can be positioned at any suitable location on the tub 14 such that the liquid from the liquid outlet 122 can be provided to the space between the tub 14 and the drum 16 to reach the sump 70.

The set of fins 150, as illustrated herein, is provided and extends along at least a portion of the rear wall 102, oriented and positioned such that the plurality of fins 170 extending from the plate 160 extend from only a single side of the plate 160. More specifically, the plurality of fins 170 extend from the single side of the plate 160 in a direction away from the condenser liquid flow pathway 140, and further such that the plurality of fins 170 are in thermal contact with the ambient air in the cabinet interior 13.

In one example, the at least a portion of the rear wall 102 that is coextensive with the set of fins 150 can form and be provided as the plate 160 for the set of fins 150 such that the plurality of fins 170 are coupled directly to at least the coextensive portion of the rear wall 102 with no additional or intervening plate 160. Alternatively, the plate 160 can be provided such that it is not integral with or formed by the rear wall 102, but rather is coupled to the at least a portion of the rear wall 102 that is coextensive with the set of fins 150 and provided between the plurality of fins 170 and the rear wall 102.

In either example, whether the rear wall 102 is provided as the plate 160 or the rear wall 102 is separate from the plate 160, the set of fins 150, and thus also the plate 160, is spaced from the condenser air flow pathway 130, and thus also from the air recirculation circuit 60, such as spaced apart by at least the condenser liquid flow pathway 140. For example, the condenser liquid flow pathway 140 can be provided in the space between the set of fins 150, along with the plate 160, and the condenser air flow pathway 130, along with the air recirculation circuit 60, and specifically such as the portion of the air recirculation circuit 60 that comprises or couples the condenser air flow pathway 130. Further, because the condenser liquid flow pathway 140 is at least partially defined by the rear wall 102, in the case that the portion of the rear wall 102 forms and is provided as the plate 160 for the set of fins 150, the plate 160 can therefore also be thought of as defining a portion of, or as at least partially defining, the condenser liquid flow pathway 140.

Turning now to the operation of the liquid-cooled condenser 32, when the cycle of operation of the laundry treating appliance 10 is a cycle of operation that includes the operation of the air recirculation circuit 60, the controller 96 directs operation of the blower 34 to drive the supply of air through the air recirculation circuit 60 and along the air flow pathway 30. In one example, air that is drawn from the treating chamber 18 can be process air, such as moisture-laden process air, that exits the treating chamber 18 through the treating chamber air outlet 59 to be provided to and to enter the liquid-cooled condenser 32 through the condenser air inlet 110. The moisture-laden process air is provided through the liquid-cooled condenser 32, from the condenser air inlet 110 to the condenser air outlet 112, for condensing of at least some of the moisture out of the initially moisture-laden process air. The process air flows through the liquid-cooled condenser 32, which can be thought of as a portion of the air recirculation circuit 60, such as along the air flow pathway 30, and more specifically along the condenser air flow pathway 130 portion of the air recirculation circuit 60 that extends through the condenser housing 100. The process air flowing through the air recirculation circuit 60, and, more specifically, the process air flowing along the condenser air flow pathway 130, flows within the liquid-cooled condenser 32 in a first direction, corresponding to the arrows 130, for condensing and in order to reach the condenser air outlet 112, where the process air is then provided through the condenser air outlet 112 to the blower 34.

In a further aspect of the operation of the air recirculation circuit 60, during at least a portion of the time that the blower 34 is operated to drive the supply of air through the liquid-cooled condenser 32, the controller 96 can additionally direct operation of the liquid supply assembly to drive the supply of liquid through the liquid-cooled condenser 32, such as by the supply of liquid to the condenser conduit 33, and therefore also to the condenser spray nozzle 49. In one example, the controller 96 can be configured such that liquid is supplied through the liquid-cooled condenser 32 during any time that air is supplied through the liquid-cooled condenser 32, though it will be understood that the supply of liquid through the liquid-cooled condenser 32 is not limited to such a condition. Further, the controller 96 can operate the liquid supply assembly such that when liquid is supplied through the liquid-cooled condenser 32, the liquid supplied is specifically cold water, to promote the performance and efficiency of the condensing by the liquid-cooled condenser 32.

During the supply of liquid through the liquid-cooled condenser 32, the liquid supply assembly, such as at least the valve 44 and the first diverter mechanism 48 can be operated or positioned such that liquid is supplied to the condenser conduit 33, to be further sprayed from the condenser spray nozzle 49 into the liquid-cooled condenser 32. In one example, liquid is provided from the condenser spray nozzle 49 to be supplied into the liquid-cooled condenser 32 through the liquid inlet 120. The liquid can be supplied through the liquid inlet 120 by the condenser spray nozzle 49 to specifically be supplied into, such as by being sprayed into, the condenser liquid flow pathway 140. The liquid supplied into the condenser liquid flow pathway 140 can be supplied to flow along the rear wall 102, and further can be specifically sprayed from the condenser spray nozzle 49 onto at least a portion of the rear wall 102, and further still can be specifically sprayed from the condenser spray nozzle 49 onto the at least a portion of the rear wall 102 that is coextensive with the set of fins 150. Additionally, in the example wherein the portion of the rear wall 102 forms, and is provided, as the plate 160 for the set of fins 150, the spraying of liquid from the condenser spray nozzle 49 onto the at least a portion of the rear wall 102 can therefore also be thought of as specifically spraying liquid from the condenser spray nozzle 49 onto the plate 160.

The liquid that is supplied to the liquid-cooled condenser 32, and specifically into the condenser liquid flow pathway 140 by the condenser spray nozzle 49 and through the liquid inlet 120, flows downwardly along the condenser liquid flow pathway 140, and in particular by flowing downwardly along the rear wall 102, which can include the plate 160, and which can also be thought of as flowing downwardly along the set of fins 150, to reach the bottom wall 104. The liquid then flows along the bottom wall 104, moving from the rear wall 102 inwardly, in a direction that is away from the set of fins 150, and toward the liquid outlet 122. Liquid flowing through the liquid outlet 122 is passed through the tub 14, such as by the liquid outlet 122 extending through an opening in a wall of the tub 14, to be provided to a space between the tub 14 and the drum 16 that either forms a portion of the sump 70 or is fluidly coupled with the sump 70. In this way, liquid that exits the liquid-cooled condenser 32 through the liquid outlet 122 can be provided to the sump 70. Such liquid that can be provided to the sump 70 includes both liquid that is sprayed from the condenser spray nozzle 49 and liquid that condenses out of the process air flowing through the condenser air flow pathway 130 and collects in the liquid-cooled condenser 32.

The liquid flowing through the condenser liquid flow pathway 140, and specifically, the liquid flowing through the portion of the condenser liquid flow pathway 140 that is provided within the condenser housing 100, flows within the liquid-cooled condenser 32 in a second direction, corresponding to the arrows 140, for condensing and to reach the liquid outlet 122. In one example, the second direction, which is the direction in which the liquid flows along the condenser liquid flow pathway 140 within the condenser housing 100, is opposite the first direction, which is the direction in which the air flows along the condenser air flow pathway 130 within the condenser housing 100.

By flowing liquid through the liquid-cooled condenser 32, such as by flowing the liquid through the condenser liquid flow pathway 140, and more specifically by flowing the liquid adjacent to and in thermal contact with the set of fins 150, the condensing performance of the liquid-cooled condenser 32 can be improved or promoted, such as by increasing the water extraction rate within the liquid-cooled condenser 32. As described previously, the plate 160 and the plurality of fins 170 can be formed of thermally conductive materials. In the example wherein the portion of the rear wall 102 forms, and is provided, as the plate 160 for the set of fins 150, the rear wall 102, then, can be formed of the thermally conductive material, at least in a portion. Even in the example wherein the rear wall 102 is separate from the plate 160, at least the rear wall 102 of the condenser housing 100, and optionally up to the entire condenser housing 100, can also be formed of a thermally conductive material. While the provision of the plate 160 as a separate, intervening layer between the rear wall 102 and the plurality of fins 170 may decrease the thermal conductivity between the rear wall 102 and the plurality of fins 170 somewhat as compared to the rear wall 102 forming the plate 160, in either example, at least some degree of thermal conductivity is provided between the condenser liquid flow pathway 140 and the plurality of fins 170, which can improve the performance of the liquid-cooled condenser 32.

For example, in one aspect, by providing the liquid through the condenser liquid flow pathway 140 to add a liquid-cooling function to the liquid-cooled condenser 32, the condensing capacity of the liquid-cooled condenser 32 is improved because the flowing or conducting of water through the liquid-cooled condenser 32 extracts heat from the liquid-cooled condenser 32 as the liquid passes through the liquid-cooled condenser 32. The cooling liquid can extract heat from the surfaces of the liquid-cooled condenser 32 that it contacts, such as the condenser housing 100, and in particular the rear wall 102 and the bottom wall 104.

In addition, the inclusion of the set of fins 150 along the rear wall 102 of the liquid-cooled condenser 32, such that the set of fins 150 are in thermal contact with the ambient air in the cabinet interior 13, also improves the condensing capacity of the liquid-cooled condenser 32. In one example, the inclusion of the set of fins 150 improves the condensing capacity by providing an increased surface area at the set of fins 150, such as at the contact surface 180, from which heat can be dissipated from the liquid-cooled condenser 32. Further, the ambient air in the cabinet interior 13 can have a lower temperature than the drying air or process air flowing through the liquid-cooled condenser 32, such that the thermal conductivity of the materials and the increased surface area of the set of fins 150 can even further dissipate heat from the liquid-cooled condenser 32 by allowing the ambient air in the cabinet interior 13 to further extract heat from the set of fins 150, an even further improvement in condensing capacity as opposed to the inclusion of the set of fins 150 alone, but without thermal contact with cooling air.

Further still, the heat extraction by the flowing of the cooling liquid through the liquid-cooled condenser 32 and the heat dissipation by the set of fins 150 can cooperate even further to improve condensing capacity of the liquid-cooled condenser 32. For example, by arranging the components of the liquid-cooled condenser 32 in the illustrated way, such that the set of fins 150 thermally contacts cooling ambient air, that the condenser liquid flow pathway 140 flows cooling liquid through the liquid-cooled condenser 32, and further that the condenser air flow pathway 130 is separated from the set of fins 150 by the condenser liquid flow pathway 140, even further improvements in condensing capacity can be realized. By positioning the condenser liquid flow pathway 140 to separate, such as to thermally shield, the set of fins 150 from the condenser air flow pathway 130, heat dissipation by the set of fins 150 is even further improved because the set of fins 150 is cooled not only by the ambient air in the cabinet interior 13, but also by way of the condenser liquid flow pathway 140 preventing at least some of the heat from ever even reaching the set of fins 150. The combination of the improved dissipation of heat that does reach the set of fins 150, and taken along with the use of liquid cooling, both for heat extraction and for preventing the heat from reaching the set of fins 150 and requiring dissipation, allows additive benefits to the condensing capacity of the liquid-cooled condenser 32 to be realized, even beyond the summation of the benefits of the two approaches taken separately.

The aspects of the present disclosure described herein set forth a liquid-cooled condenser with improved condensing capacity as compared to a typical conventional condenser that is not liquid-cooled. Such a conventional condenser may not include any condensing-enhancing features, other than the properties of the material from which the conventional condenser is formed. Since such conventional condensers may be formed from plastic rather than a thermally conductive metal, even the material properties of the conventional condenser provide very little condensing-enhancing benefit as the plastic material may have low thermal conductivity. The improved condensing capacity of the liquid-cooled condenser also results in an improved extraction rate of the laundry treating appliance. In one example, as compared to a basic conventional condenser, the extraction rate of the laundry treating appliance, such as in a combination washing/drying laundry treating appliance including the liquid-cooled condenser, can be improved by as much as 70% as compared to the conventional condenser. Specifically, the operation of the liquid-cooled condenser with the added heat extraction and heat dissipation due to the set of fins, such as by improved interaction with the ambient air and by allowing cooling by ambient air of the whole condenser housing, rather than only a portion, and taken in combination with the heat extraction by the cooling water through a channel that is internal, between the set of fins and the condenser air flow pathway, the water extraction rate of the laundry treating appliance can improve from 12 mL/minute to 20 mL/minute.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A liquid-cooled condenser for use within a laundry treating appliance for treating laundry according to an automatic cycle of operation, the liquid-cooled condenser comprising:

an air flow passage fluidly coupled with an air recirculation circuit;

a plurality of fins spaced from the air flow passage; and a liquid flow passage provided in the space between the air flow passage and the plurality of fins.

2. The liquid-cooled condenser of claim 1 wherein the laundry treating appliance further comprises a sump, wherein liquid flowing through the liquid flow passage is provided to the sump.

3. The liquid-cooled condenser of claim 2 wherein the laundry treating appliance further comprises a treating chamber, wherein the sump is fluidly coupled to the treating chamber and to the liquid flow passage.

4. The liquid-cooled condenser of claim 1 wherein air flows through the air flow passage in a first direction and liquid flows through the liquid flow passage in a second direction.

5. The liquid-cooled condenser of claim 4 wherein the second direction is opposite the first direction.

6. The liquid-cooled condenser of claim 1 wherein the plurality of fins extends from a plate that is spaced from the air flow passage.

7. The liquid-cooled condenser of claim 6 wherein the liquid flow passage is provided between the air flow passage and the plate.

8. The liquid-cooled condenser of claim 6 wherein the plate defines a portion of the liquid flow passage.

9. The liquid-cooled condenser of claim 6 wherein the plurality of fins extends from a single side of the plate and away from the liquid flow passage, the plurality of fins in thermal contact with ambient air within the laundry treating appliance.

10. The liquid-cooled condenser of claim 6 wherein liquid supplied to the liquid flow passage is sprayed into the liquid flow passage.

11. The liquid-cooled condenser of claim 10 wherein the liquid is sprayed onto the plate.

12. The liquid-cooled condenser of claim 1 wherein a portion of the air recirculation circuit comprises the liquid-cooled condenser.

13. The liquid-cooled condenser of claim 1 wherein the plurality of fins is in thermal contact with ambient air within the laundry treating appliance.

14. The liquid-cooled condenser of claim 1 wherein the laundry treating appliance comprises a combination washing and drying laundry treating appliance.

* * * * *